US009778602B2

(12) United States Patent
Juri et al.

(10) Patent No.: US 9,778,602 B2
(45) Date of Patent: Oct. 3, 2017

(54) IMAGE FORMING APPARATUS

(71) Applicants: Keiichiro Juri, Kanagawa (JP); Hideaki Yasunaga, Tokyo (JP); Akira Izutani, Osaka (JP); Makoto Matsushita, Tokyo (JP); Hiroaki Takahashi, Kanagawa (JP); Ayano Momose, Tokyo (JP); Yuri Haga, Kanagawa (JP)

(72) Inventors: Keiichiro Juri, Kanagawa (JP); Hideaki Yasunaga, Tokyo (JP); Akira Izutani, Osaka (JP); Makoto Matsushita, Tokyo (JP); Hiroaki Takahashi, Kanagawa (JP); Ayano Momose, Tokyo (JP); Yuri Haga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/074,927

(22) Filed: Mar. 18, 2016

(65) Prior Publication Data

US 2016/0274500 A1 Sep. 22, 2016

(30) Foreign Application Priority Data

Mar. 19, 2015 (JP) ..... 2015-056849

(51) Int. Cl.
*G03G 15/16* (2006.01)

(52) U.S. Cl.
CPC ..... *G03G 15/162* (2013.01); *G03G 15/161* (2013.01); *G03G 15/1605* (2013.01)

(58) Field of Classification Search
None
See application file for complete search history.

(56) References Cited

U.S. PATENT DOCUMENTS

| | | | |
|---|---|---|---|
| 2003/0054279 | A1 | 3/2003 | Yamaguchi et al. |
| 2003/0143000 | A1 | 7/2003 | Takahashi et al. |
| 2003/0224279 | A1 | 12/2003 | Kotsugai et al. |
| 2004/0142269 | A1 | 7/2004 | Kotsugai et al. |
| 2005/0064315 | A1 | 3/2005 | Yamaguchi et al. |

(Continued)

FOREIGN PATENT DOCUMENTS

| | | |
|---|---|---|
| JP | 2010-139650 | 6/2010 |
| JP | 2010-191277 | 9/2010 |
| JP | 2015-014744 | 1/2015 |

*Primary Examiner* — Thomas Giampaolo, II
(74) *Attorney, Agent, or Firm* — Cooper & Dunham LLP

(57) ABSTRACT

An image forming apparatus includes at least an image bearer; an electrostatic latent image former to form an electrostatic latent image on the image bearer; an image developer to develop the electrostatic latent image with a toner to from a toner image; a first transferer to transfer the toner image from the image bearer onto an intermediate transfer belt; and a cleaner including a cleaning blade having a Martens hardness of from 0.8 to 10.0 $N/m^2$, to clean the intermediate transfer belt while contacting the surface of the intermediate transfer belt. The intermediate transfer belt includes a thermoplastic resin and a conductive resin, and has a surface concentration of oxygen atoms derived from the conductive resin, measured by XPS, of from 1.0% to 3.0% by atom.

4 Claims, 1 Drawing Sheet

(56) References Cited

U.S. PATENT DOCUMENTS

2006/0051140 A1* 3/2006 Shimomura ..... G03G 15/1685 399/303
2006/0204882 A1 9/2006 Nozaki et al.
2006/0210908 A1 9/2006 Umemura et al.
2006/0275686 A1 12/2006 Kadota et al.
2007/0059625 A1 3/2007 Yamamoto et al.
2007/0122729 A1 5/2007 Katoh et al.
2007/0148568 A1 6/2007 Kadota et al.
2007/0190443 A1 8/2007 Hagi et al.
2007/0207399 A1 9/2007 Kadota et al.
2007/0212630 A1 9/2007 Yasunaga et al.
2007/0217842 A1 9/2007 Kato et al.
2007/0238042 A1 10/2007 Yasunaga et al.
2008/0038656 A1 2/2008 Yasunaga et al.
2008/0063957 A1 3/2008 Murakami et al.
2008/0069594 A1 3/2008 Izutani
2008/0069598 A1 3/2008 Murakami et al.
2008/0069599 A1 3/2008 Nakamura et al.
2008/0069605 A1 3/2008 Fuwa et al.
2008/0069608 A1 3/2008 Katoh et al.
2008/0070149 A1 3/2008 Kato et al.
2008/0153018 A1 6/2008 Mikuriya et al.
2008/0159777 A1 7/2008 Fuwa et al.
2008/0175630 A1 7/2008 Yasunaga et al.
2008/0199234 A1 8/2008 Hagi et al.
2008/0226356 A1 9/2008 Yasunaga et al.
2008/0226997 A1 9/2008 Nakamura et al.
2008/0227009 A1 9/2008 Fuwa et al.
2008/0232849 A1 9/2008 Izutani et al.
2008/0232864 A1 9/2008 Izutani et al.
2008/0233506 A1 9/2008 Hagi et al.
2008/0279591 A1 11/2008 Yasunaga et al.
2008/0304875 A1 12/2008 Katoh et al.
2009/0041511 A1 2/2009 Fuwa et al.
2009/0052952 A1 2/2009 Katoh et al.
2009/0060540 A1 3/2009 Matsushita et al.
2009/0117481 A1 5/2009 Yasunaga et al.
2009/0142107 A1 6/2009 Akira et al.
2009/0154971 A1* 6/2009 Itoh ..... G03G 9/0819 399/350
2009/0169270 A1 7/2009 Fuwa et al.
2009/0180791 A1 7/2009 Matsushita et al.
2009/0186289 A1 7/2009 Nakamura et al.
2009/0186291 A1 7/2009 Mikuriya et al.
2009/0190949 A1 7/2009 Hamahashi et al.
2009/0196638 A1 8/2009 Sukesako et al.
2009/0238585 A1 9/2009 Hayashi et al.
2009/0257792 A1 10/2009 Nakamura et al.
2009/0279909 A1 11/2009 Matsushita et al.
2009/0324270 A1 12/2009 Yamashita et al.
2010/0009282 A1 1/2010 Katoh et al.
2010/0055603 A1 3/2010 Nozaki et al.
2010/0167196 A1 7/2010 Hagi et al.
2010/0272481 A1 10/2010 Yamamoto et al.
2010/0296848 A1 11/2010 Yamamoto et al.
2011/0008069 A1 1/2011 Matsushita et al.
2011/0217653 A1 9/2011 Izutani et al.
2011/0243616 A1 10/2011 Nakagawa et al.
2011/0249994 A1 10/2011 Matsushita et al.
2012/0237270 A1 9/2012 Juri et al.
2012/0299657 A1 11/2012 Matsushita et al.
2012/0315067 A1 12/2012 Takahashi
2013/0058685 A1 3/2013 Juri et al.
2013/0149540 A1* 6/2013 Sato ..... G03G 15/162 428/411.1
2014/0212184 A1 7/2014 Juri et al.
2014/0243465 A1 8/2014 Matsushita et al.
2014/0321888 A1 10/2014 Yasunaga et al.
2015/0014602 A1 1/2015 Matsushita et al.
2015/0078777 A1 3/2015 Juri et al.
2015/0078790 A1 3/2015 Ishikawa et al.
2015/0078791 A1 3/2015 Momose et al.
2016/0004191 A1 1/2016 Juri et al.

* cited by examiner

IMAGE FORMING APPARATUS

CROSS-REFERENCE TO RELATED APPLICATIONS

This patent application is based on and claims priority pursuant to 35 U.S.C. §119 to Japanese Patent Application No. 2015-056849 filed on Mar. 19, 2015, in the Japan Patent Office, the entire disclosure of which is hereby incorporated by reference herein.

BACKGROUND

Technical Field

The present invention relates to an image forming apparatus using an intermediate transfer belt.

Description of the Related Art

As an electrophotographic image forming apparatus, an image forming apparatus using an intermediate transferer is known. In the apparatus, a toner image formed on a photoconductor is first transferred onto an intermediate transferer, and then the toner image thereon is second transferred onto a transfer material. As the intermediate transferer, an intermediate transfer belt which is an endless belt is widely used.

In the image forming apparatus using an intermediate transferer, a toner which is not transferred onto the transfer material after the second transfer (residual toner after the second transfer) remains on the intermediate transfer belt. Therefore, a cleaning process removing the residual toner after the second transfer on the intermediate transfer belt before a following image is transferred thereonto is needed. For the cleaning process, blade cleaning methods using a cleaning blade formed of an elastic body such as a urethane rubber as a cleaning member are widely used. The cleaning blade is often installed at an acute angle relative to a travel direction of the intermediate transfer belt to improve its cleanability. Namely, the cleaning blade is often contacted to almost all width nearly perpendicular to the travel direction of the intermediate transfer belt while a free end of the cleaning blade contacting thereto faces upstream of the travel direction of the intermediate transfer belt. Such a method of cleaning the intermediate transfer belt is known.

An intermediate transfer belt formed by extrusion using a thermoplastic resin is cleaned by the above method as well. However, foreign matters are inserted in between the intermediate transfer belt and the edge of the cleaning blade.

The foreign matters are peculiarly are inserted in therebetween when the intermediate transfer belt is formed by extrusion using a thermoplastic resin. A skin layer formed on the surface of the intermediate transfer belt is scraped off by friction with the cleaning blade.

SUMMARY

An image forming apparatus includes at least an image bearer; an electrostatic latent image former to form an electrostatic latent image on the image bearer; an image developer to develop the electrostatic latent image with a toner to from a toner image; a first transferer to transfer the toner image from the image bearer onto an intermediate transfer belt; and a cleaner including a cleaning blade having a Martens hardness of from 0.8 to 10.0 N/m$^2$, to clean the intermediate transfer belt while contacting the surface of the intermediate transfer belt. The intermediate transfer belt includes a thermoplastic resin and a conductive resin, and has a surface concentration of oxygen atoms derived from the conductive resin, measured by XPS, of from 1.0% to 3.0% by atom.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
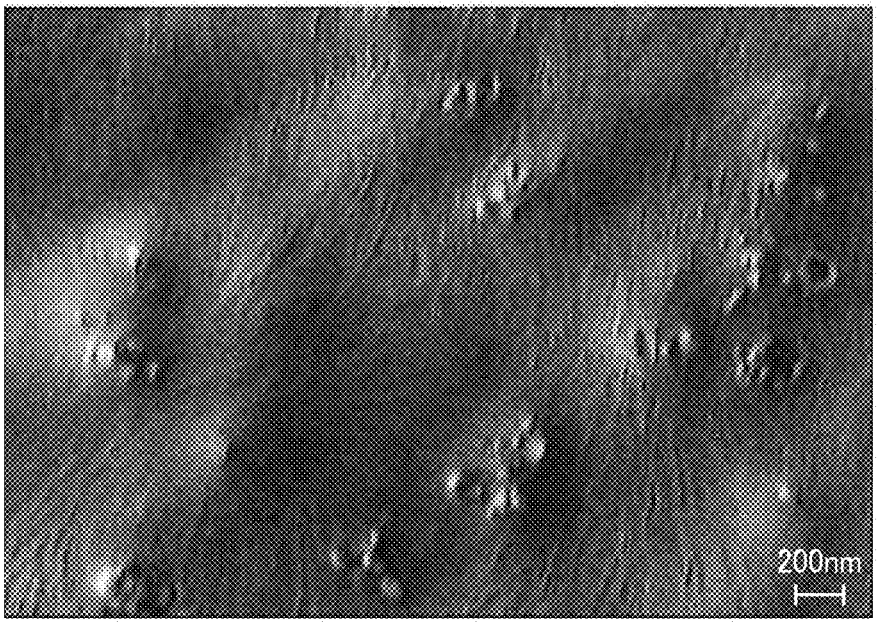
FIG. 1 is a photomicrograph of the surface of an intermediate transfer belt including a skin layer, which has a crystallized structure.

The present invention provides an image forming apparatus using an intermediate transfer belt stably cleanable for long periods, which is free from defective cleaning due to a skin layer formed on the surface of the intermediate transfer belt formed by extrusion using materials including a thermoplastic resin.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The image forming apparatus of the present invention includes at least an image bearer; an electrostatic latent image former to form an electrostatic latent image on the image bearer; an image developer to develop the electrostatic latent image with a toner to from a toner image; a first transferer to transfer the toner image onto an intermediate transfer belt; and a cleaning blade to clean the intermediate transfer belt while contacting the surface thereof as a cleaner.

The intermediate transfer belt includes a thermoplastic resin and a conductive resin and has a concentration of oxygen atoms derived from the conductive resin of from 1.0% by atom to 3.0% by atom when the surface thereof is measured by XPS. The cleaning blade has a tip ridgeline at one side and a Martens hardness of from 0.8 N/m$^2$ to 10.0 N/m$^2$ when the undersurface of the blade opposite to the surface of the intermediate transfer belt is pushed in by 5 μm at a position 20 μm from the tip ridgeline.

The image forming apparatus may include a second transferer to transfer the toner image on the intermediate transfer belt onto a recording medium and a fixer to fix the toner image thereon when necessary.

A skin layer on which a lamellar layer and a fibril, which are crystallized thermoplastic resins, are observed is present on the surface thereof formed by extrusion using materials including a thermoplastic resin. The skin layer can be removed with a cleaning blade having high abradability or hardness. However, when the skin layer remains by halves without being fully removed, the remaining skin layer causes defective cleaning.

In the present invention, the defective cleaning is solved by controlling the concentration of oxygen atoms derived from the conductive resin to be from 1.0% to 3.0% by atom. The intermediate transfer belt satisfying this requirement is obtained by abrading the surface thereof by buff polishing or blasting to remove the skin layer. The intermediate transfer belt preferably has a surface roughness Ra of from 0.03 to 0.07 μm after abraded. In addition, the intermediate transfer belt preferably has a surface glossiness not less than 40 at an incident angle of 20°.

Figure 2:
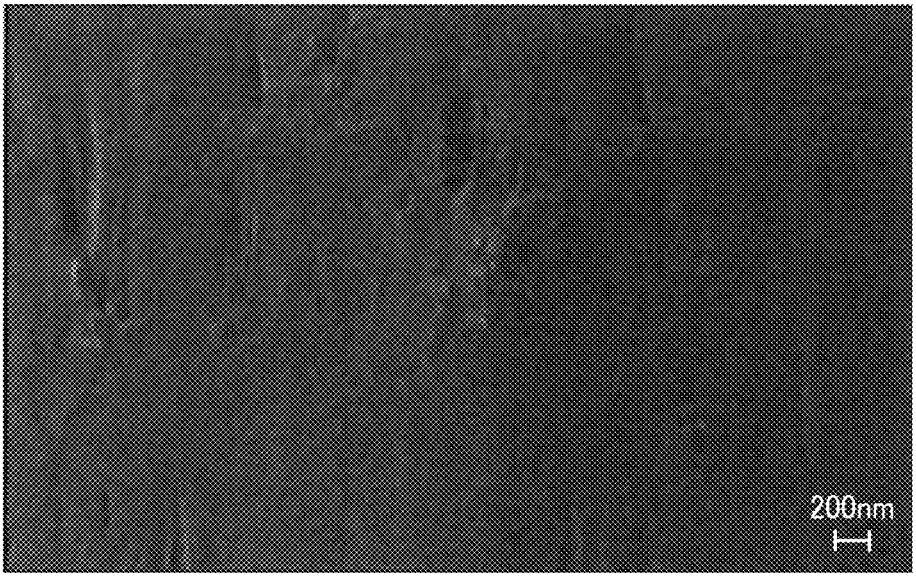
FIG. 2 is a photomicrograph of the surface of an intermediate transfer belt including no skin layer, which has no crystallized structure.

The intermediate transfer belt the skin layer is removed from does not expose crystallized thermoplastic resin on the surface. FIG. 1 is a photomicrograph of the surface of an intermediate transfer belt including a skin layer, and FIG. 2 is a photomicrograph of the surface thereof including no skin layer. FIG. 1 has a crystallized structure and FIG. 2 has no crystallized structure.

The intermediate transfer belt is preferably used in an image forming apparatus including a cleaning blade having a Martens hardness of from 0.8 $N/m^2$ to 10.0 $N/m^2$ as a cleaner and can stably be cleaned for long periods. The intermediate transfer belt is typically used in the shape of an endless belt.

Specific examples of the thermoplastic resin as a material for the intermediate transfer belt include polyvinylidenefluoride, a copolymer including vinylidenefluoride and hexafluoropropylene, polypropylene, polystyrene, polyphenylene sulfide, etc.

Specific examples of the conductive resin as a material for the intermediate transfer belt include polyether esteramide, a block copolymer of polyether and polyolefin, etc. Specific examples of the polyolefin include polymers having functional groups such as carboxyl groups, hydroxyl groups and amino groups.

The content of the conductive resin is preferably from 3 to 9 parts by weight per 100 parts by weight of the thermoplastic resin to suppress bleeding of the conductive resin on the surface of the belt, and further the belt has high smoothness and good surfaceness.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Examples 1 to 9 and Comparative Examples 1 to 4

Preparation of Intermediate Transfer Belt

Each of the following resin compositions was melted and extruded to prepare an intermediate transfer belt having the shape of an endless belt, and the surface of the belt was abraded by buff polishing.

The contents of the materials $X_1$ to $X_5$ and $Y_1$ to $Y_4$ are shown in Table 1.

<Polyether Ester Amides>

Resin Compositions 1 and 1'

The following materials were dry-blended.

| | |
|---|---|
| Polyvinylidene fluoride (Kynar 721 from Arkema) | $X_1$ |
| Copolymer of vinylidenefluoride and hexafluoropropylene (Kynar 2751 from Arkema) | $X_2$ |
| Carbon black (DENKA BLACK having an average primary particle diameter of 35 nm from Denka Company Limited) | 7.5 |
| Conductive resin of polyether ester amide (PELECTRON AS from Sanyo Chemical Industries, Ltd.). | $Y_1$ |

Next, after the mixture were kneaded b a kneader for 80 min while heated at a temperature not greater than a melting point of the resin, the mixture was pelletized by a pelletizer to prepare pellet-shaped resin compositions 1 and 1'.

Resin Compositions 2 and 2'

The procedure for preparation of the resin compositions 1 and 1' was repeated except for replacing $Y_1$ parts of conductive resin of polyether ester amide with $Y_2$ parts of conductive resin of polyether ester amide (Irgastat P-18 from BASF).

Resin Compositions 3 and 3'

The procedure for preparation of the resin compositions 1 and 1' was repeated except for replacing $Y_1$ parts of conductive resin of polyether ester amide with $Y_3$ parts of conductive resin of polyether ester amide (MH1657 from Arkema).

Resin Composition 4

The following materials were dry-blended.

| | |
|---|---|
| Polyvinylidene fluoride (Kynar 721 from Arkema) | $X_1$ |
| Carbon black (DENKA BLACK having an average primary particle diameter of 35 nm from Denka Company Limited) | 7.5 |
| Conductive resin of polyether ester amide (MH1657 from Arkema) | $Y_3$ |

Next, after the mixture were kneaded b a kneader for 80 min while heated at a temperature not greater than a melting point of the resin, the mixture was pelletized by a pelletizer to prepare pellet-shaped resin composition 4.

Resin Composition 5

The following materials were dry-blended.

| | |
|---|---|
| Polyphenylene sulfide (TORELINA A900 from Toray Industries, Inc.) | $X_4$ |
| Carbon black (DENKA BLACK having an average primary particle diameter of 35 nm from Denka Company Limited) | 7.5 |
| Conductive resin of polyether ester amide (MH1657 from Arkema) | $Y_3$ |

Next, after the mixture were kneaded b a kneader for 80 min while heated at a temperature not greater than a melting point of the resin, the mixture was pelletized by a pelletizer to prepare pellet-shaped resin composition 5.

Resin Composition 6

The following materials were dry-blended.

| | |
|---|---|
| Polystyrene (Dicstyrene XC-315 from DIC Corp.) | $X_5$ |
| Carbon black (DENKA BLACK having an average primary particle diameter of 35 nm from Denka Company Limited) | 7.5 |
| Conductive resin of polyether ester amide (MH1657 from Arkema) | $Y_3$ |

Next, after the mixture were kneaded b a kneader for 80 min while heated at a temperature not greater than a melting point of the resin, the mixture was pelletized by a pelletizer to prepare pellet-shaped resin composition 6.

<Copolymer of Polyether and Olefin>

Resin Composition 7

The following materials were dry-blended.

| | |
|---|---|
| Polyvinylidene fluoride (Kynar 721 from Arkema) | $X_1$ |
| Copolymer of vinylidenefluoride and hexafluoropropylene (Kynar 2751 from Arkema) | $X_2$ |
| Carbon black (DENKA BLACK having an average primary particle diameter of 35 nm from Denka Company Limited) | 7.5 |
| Block copolymer of polyether and olefin (PELECTRON PVH from Sanyo Chemical Industries, Ltd.). | $Y_4$ |

Next, after the mixture were kneaded b a kneader for 80 min while heated at a temperature not greater than a melting point of the resin, the mixture was pelletized by a pelletizer to prepare pellet-shaped resin composition 7.

Resin Composition 8

The following materials were dry-blended.

| | |
|---|---|
| Polypropylene (NOVATEC EH7FTB from Japan Polypropylene Corp.) | $X_3$ |
| Carbon black (DENKA BLACK having an average primary particle diameter of 35 nm from Denka Company Limited) | 7.5 |
| Block copolymer of polyether and olefin (PELECTRON PVH from Sanyo Chemical Industries, Ltd.). | $Y_4$ |

Next, after the mixture were kneaded b a kneader for 80 min while heated at a temperature not greater than a melting point of the resin, the mixture was pelletized by a pelletizer to prepare pellet-shaped resin composition 8.

Cleaning Blade

The following blades 1 to 10 were used.

Blade 1

Urethane rubber: Martens hardness 0.8 N/mm$^2$ from Toyo Tire & Rubber Co., Ltd.

Blade 2

Urethane rubber: double-layered, contact surface Martens hardness of 1.5 N/mm$^2$, and the other side Martens hardness of 0.6 N/mm$^2$ from Toyo Tire & Rubber Co., Ltd.

Blade 3

A cleaning blade prepared according to Example 4 in Japanese published unexamined application No. JP-2014-178441-A (Martens hardness 3.5 N/mm$^2$.

Blades 4 to 9

After a urethane rubber having a hardness of 68 and an impact resilience of 30% at 25° C. from Toyo Tire & Rubber Co., Ltd. was impregnated in a coating liquid having the following composition, the rubber was irradiated with UV and fired in a furnace at 100° C. for 15 min to prepare blades 4 to 9. An impregnation time and a Martens hardness of each of the blades were as follows. The Martens hardness was a value measured by a microscopic hardness tester meter FISCHERSCOPE HM2000 from Fischer Technology, Inc. when the surface of the blade 20 μm from the tip of the blade was pushed in by 5 μm.

[Coating Liquid Composition]

| | |
|---|---|
| UV curing resin 1: Pentaerythritoltriacrylate (PETIA from DAICEL-CYTEC Co., Ltd., having three functicnal groups and a functional group equivalent 99) | 8 |

-continued

| | |
|---|---|
| UV curing resin 2: Octyl/Decylacrylate (ODA-N from DAICEL-CYTEC Co., Ltd., having one functional group and a functional group equivalent 226) | 2 |
| UV curing resin 3: Fluorine acrylate (OPTOOL DAC-HP from Daikin Industries, Ltd.) | 0.1 |
| Polymerization initiator: 1.2α hydroxy alkyl phenone (Irgacure 184 from Ciba Specialty Chemicals, Ltd.) | 0.5 |
| Solvent: Cyclohexanone | 89.4 |

Blade 4: Impregnation time 15 min and Martens hardness of 3.3 N/mm$^2$

Blade 5: Impregnation time 15 min and Martens hardness of 4.5 N/mm$^2$

Blade 6: Impregnation time 30 min and Martens hardness of 7.5 N/mm$^2$

Blade 7: Impregnation time 31 min and Martens hardness of 7.6 N/mm$^2$

Blade 8: Impregnation time 40 min and Martens hardness of 10.0 N/mm$^2$

Blade 9: Impregnation time 42 min and Martens hardness of 10.2 N/mm$^2$

Blade 10: Martens hardness 0.7 N/mm$^2$ from Toyo Tire & Rubber Co., Ltd.

The intermediate transfer belts and the cleaning blades were combined as in Table 1 and installed in a laser printer IPSiO SP C730 from Ricoh Company, Ltd. to prepare image forming apparatuses of Examples and Comparative Examples. The following properties of each of the apparatuses were evaluated. The results are shown in Table 2.

Measurement of Oxygen Atom Concentration (% by atom) on the Surface of Intermediate Transfer Belt by XPS X-ray photoelectron spectroscopy (XPS) analyzes atoms and their concentrations until a depth of some nm from the surface of an object, and atoms bonded therewith and their bonding states. An element composition (% by atom) was calculated by converting peak areas correspondent to C1S and O1S after a bonding energy was measured by an XPS analyzer K-Alpha from Thermo Fisher Scientific K.K. It is thought that C1S signal is derived from fluorine resins or carbon black constituting the intermediate transfer belt, and that O1S signal is derived from an ether bond the conductive resin dispersed in the substrate has. Therefore, ratios thereof are compared with each other to relatively observe an amount of the conductive resin present until a depth of some nm from the surface of the intermediate transfer belt. Fluorine atoms and carbon atoms were measured first because of being readily damaged by X-ray.

Observation of Crystallized Structure on the Surface of Intermediate Transfer Belt A second electron image of the surface of the intermediate transfer belt was observed by FE-SEM S-4800 from Hitachi High-Technologies Corp. at 20,000 times to evaluate under the following criteria.

[Evaluation Criteria]

Good: No crystallized structure such as fibril and lamellar was observed

Poor: Crystallized structures such as fibril and lamellar were observed

Measurement of Glossiness on the Surface of Intermediate Transfer Belt

A surface glossiness of the intermediate transfer belt was measured by GROSS CHECKER IG-320 from Horiba, Ltd., and evaluated under the following criteria. An LED having a wavelength of 880 nm was used as a light source, and an incident angle and an acceptance angle were both 20°.

[Evaluation Criteria]

Excellent: The surface glossiness was not less than 60

Good: The surface glossiness was not less than 40 and less than 60

Poor: The surface glossiness was less than 40

Measurement of Surface Roughness of Intermediate Transfer Belt

The surface roughness was measured by a laser microscope LEXT OLS4000 from Olympus Corp. at a roughness measurement mode and a measurement distance of 2 mm to obtain Ra from the data analysis, and evaluated under the following criteria.

[Evaluation Criteria]

Excellent: 0.03 μm≤Ra≤0.05 μm

Good: 0.05 μm<Ra≤0.07 μm

Poor: Ra<0.03 μm or Ra>0.07 μm

Bleed out Resistance of Intermediate Transfer Belt

A photoconductor was taken out from a developing unit of a laser printer IPSiO SP C730 from Ricoh Company, Ltd., and a strip-shaped sheet cut out from the intermediate transfer belt was wound around the photoconductor. The photoconductor was left in an environment of 45° C. and 95% Rh for 10 days. Then, the wound sheet was released from the photoconductor and the photoconductor was installed again in the developing unit to produce images.

[Evaluation Criteria]

Good: A halftone image was produced on the first sheet, and the image had uniform density and no abnormality Poor: Abnormal images such as white spots were produced at a part the sheet was wound around Evaluation of Defective Cleaning The intermediate transfer belts and the cleaning blades of Examples and Comparative Examples in Table 1 were installed in a laser printer IPSiO SP C730 from Ricoh Company, Ltd. to test durability of cleanability. In an environment of 23° C. and 45% Rh, 5,000 pieces of image pattern having printed rate of 0.5% were produced on PPC PAPER High White A4. A halftone image was produced to evaluate cleanability under the following criteria.

[Evaluation Criteria]

Excellent: Even after 5,000 images were produced, a foreign matter did not adhered to the edge of the cleaning blade Good: After 5,000 images were produced, some foreign matters adhered to the edge of the cleaning blade, but which is not a problem in practical use because no stripes appeared on the images Poor: After 5,000 images were produced, many foreign matters adhered to the edge of the cleaning blade, which cause many stripes on the images

TABLE 1

| | Resin | Inter mediate Transfer Belt | | | | | | | | | Cleaning Blade | |
|---|---|---|---|---|---|---|---|---|---|---|---|---|
| | Comp. | $X_1$ | $X_2$ | $X_3$ | $X_4$ | $X_5$ | $Y_1$ | $Y_2$ | $Y_3$ | $Y_4$ | No. | Martens Hardness |
| Example 1 | 1 | 74.5 | 15.0 | — | — | — | 3.0 | — | — | — | 2 | 1.5 |
| Example 2 | 1' | 72.5 | 13.0 | — | — | — | 5.0 | — | — | — | 3 | 3.5 |
| Example 3 | 2 | 74.5 | 15.0 | — | — | — | — | 7.0 | — | — | 4 | 3.3 |
| Example 4 | 2' | 72.5 | 13.0 | — | — | — | — | 5.0 | — | — | 7 | 7.6 |
| Example 5 | 3 | 74.5 | 15.0 | — | — | — | — | — | 3.0 | — | 6 | 7.5 |
| Example 6 | 3' | 72.5 | 13.0 | — | — | — | — | — | 5.0 | — | 5 | 4.5 |
| Example 7 | 8 | — | — | 87.5 | — | — | — | — | — | 5.0 | 8 | 10.0 |
| Example 8 | 6 | — | — | — | — | 89.5 | — | — | 3.0 | — | 5 | 4.5 |
| Example 9 | 5 | — | — | — | 88.5 | — | — | — | 9.0 | — | 1 | 0.8 |
| Comparative Example 1 | 3 | 74.5 | 15.0 | — | — | — | — | — | 3.0 | — | 9 | 10.2 |
| Comparative Example 2 | 4 | 87.5 | — | — | — | — | — | — | 5.0 | — | 10 | 0.7 |
| Comparative Example 3 | 7 | 73.5 | 14.0 | — | — | — | — | — | — | 5.0 | 5 | 4.5 |
| Comparative Example 4 | 1 | 74.5 | 15.0 | — | — | — | 3.0 | — | — | — | 1 | 0.8 |

TABLE 2

| | Oxygen at. % by XPS | Surface Crystallization Structure | Surface Glossiness (20°) | Surface Roughness | Bleed Out Resistance | Defective Cleaning |
|---|---|---|---|---|---|---|
| Example 1 | 2.0 | Good | Good | Good | Good | Good |
| Example 2 | 3.0 | Good | Good | Excellent | Good | Excellent |
| Example 3 | 2.9 | Good | Good | Good | Good | Good |
| Example 4 | 1.0 | Good | Good | Good | Good | Good |
| Example 5 | 1.1 | Good | Good | Good | Good | Excellent |
| Example 6 | 2.2 | Good | Excellent | Excellent | Good | Excellent |
| Example 7 | 2.6 | Good | Good | Good | Good | Excellent |
| Example 8 | 1.7 | Good | Excellent | Good | Good | Excellent |
| Example 9 | 3.0 | Good | Excellent | Good | Good | Excellent |
| Comparative Example 1 | 1.0 | Good | Good | Good | Good | Poor |
| Comparative Example 2 | 2.0 | Poor | Good | Good | Good | Poor |
| Comparative Example 3 | 3.1 | Good | Poor | Poor | Poor | Poor |

TABLE 2-continued

| | Oxygen at. % by XPS | Surface Crystallization Structure | Surface Glossiness (20°) | Surface Roughness | Bleed Out Resistance | Defective Cleaning |
|---|---|---|---|---|---|---|
| Comparative Example 4 | 0.9 | Poor | Poor | Poor | Poor | Poor |

Having now fully described the invention, it will be apparent to one of ordinary skill in the art that many changes and modifications can be made thereto without departing from the spirit and scope of the invention as set forth therein.

What is claimed is:

1. An intermediate transfer belt for an electrophotographic image forming apparatus, the intermediate transfer belt comprising:

a thermoplastic resin and a conductive resin, wherein a content of the conductive resin is 3 to 9 parts by weight per 100 parts by weight of the thermoplastic resin, and a surface concentration of oxygen atoms derived from the conductive resin, measured by XPS, is in a range from 1.0% to 3.0% by atom.

2. The intermediate transfer belt of claim 1, wherein the thermoplastic resin includes at least one member selected from the group consisting of polyvinylidene difluoride, copolymers of vinylidene difluoride and hexafluoropropylene, polypropylene, polystyrene and polyphenylenesulfide.

3. The intermediate transfer belt of claim 1, wherein the conductive resin includes polyether esteramide or a block copolymer of polyether and polyolefin.

4. The intermediate transfer belt of claim 1, wherein the intermediate transfer belt has a surface roughness Ra of from 0.03 to 0.07 μm.

* * * * *